US005695132A

United States Patent [19]

Gorzka, Jr. et al.

[11] Patent Number: 5,695,132

[45] Date of Patent: Dec. 9, 1997

[54] AIR ACTUATED NOZZLE PLUGS

[75] Inventors: Joseph F. Gorzka, Jr., Rochester; Scott M. Smith, Webster; Gene T. Tomasino, Rochester, all of N.Y.

[73] Assignee: Xerox Corporation, Stamford, Conn.

[21] Appl. No.: 583,828

[22] Filed: Jan. 11, 1996

[51] Int. Cl.[6] ..... B02C 19/06

[52] U.S. Cl. ..... 241/39; 241/5; 241/41; 241/47

[58] Field of Search ..... 241/38, 39, 41, 241/47, 48, 52, 57, 59, 5, 18, 40

[56] References Cited

U.S. PATENT DOCUMENTS

| | | | |
|---|---|---|---|
| 2,256,841 | 9/1941 | Hardinge | 241/41 |
| 2,386,401 | 10/1945 | Joyce | 241/47 |
| 2,908,422 | 10/1959 | Braun | 241/47 X |
| 3,190,568 | 6/1965 | Freedman et al. | 241/47 X |
| 4,018,388 | 4/1977 | Andrews | 241/39 |
| 4,198,004 | 4/1980 | Albus et al. | 241/39 |
| 4,248,387 | 2/1981 | Andrews | 241/5 |
| 4,363,451 | 12/1982 | Edney et al. | 241/39 |
| 4,504,017 | 3/1985 | Andrews | 241/40 |
| 4,505,196 | 3/1985 | Beisel | 241/39 X |
| 4,860,959 | 8/1989 | Handleman | 241/5 X |
| 4,880,169 | 11/1989 | Zander et al. | 241/39 X |
| 4,905,918 | 3/1990 | Selles et al. | 241/41 X |
| 5,129,586 | 7/1992 | Artemjev et al. | 241/39 X |
| 5,133,504 | 7/1992 | Smith et al. | 241/5 |
| 5,402,947 | 4/1995 | Petersen | 241/39 |
| 5,624,079 | 4/1997 | Higuchi et al. | 241/39 |

FOREIGN PATENT DOCUMENTS

| | | | |
|---|---|---|---|
| 1021274 | 2/1953 | France | 241/38 |
| 720009 | 3/1980 | U.S.S.R. | 241/39 |

*Primary Examiner*—Andrea L. Pitts
*Assistant Examiner*—Julie A. Krolikowski
*Attorney, Agent, or Firm*—John S. Wagley

[57] ABSTRACT

A mill for grinding marking particles utilizing a source of a pressurized fluid is provided. The mill includes a grinding chamber having a peripheral wall, a base and a central axis. The mill also includes a nozzle associated with the peripheral wall of the grinding chamber. The nozzle defines an inlet of the nozzle. The inlet is connectable to the source of pressurized fluid. The pressurized fluid propels the marking particles about the periphery of the chamber. The mill further includes a plug cooperable with the nozzle. The plug is in engagement the nozzle when the pressure within the grinding chamber is substantially greater than the pressure at the inlet of the nozzle. The plug is spaced from the nozzle when the pressure within the grinding chamber is substantially less than the pressure at the inlet of the nozzle, so that when the source of pressurized fluid is connected to the inlet, the plug is spaced from the nozzle permitting the entry of the pressurized fluid into the chamber and so that when the source of pressurized fluid is disconnected from the inlet, the plug is engaged with the nozzle preventing marking particles from entering the nozzle and clogging the nozzle.

11 Claims, 5 Drawing Sheets

AIR ACTUATED NOZZLE PLUGS

The present invention relates to a method and apparatus for manufacturing toners. More particularly, the invention relates to an apparatus and method for blending toners.

In the process of electrophotographic printing, a photoconductive surface has an electrostatic latent image recorded therein. Toner particles are attracted from carrier granules to the latent image to develop the latent image. Thereafter, the toner image is transferred from the photoconductive surface to a sheet and fused thereto.

Typically, polymer based toner is produced by melt-mixing, the soft polymer in a pigment in an extruder, whereby the pigment is dispersed in the polymer. The extrudate from the extruder is cooled by spray or immersion in water as it exits the extruder. After cooling, the strands are cut with a rotary knife or other suitable means. These pellets are reduced in size by any suitable method including those known in the art. An important property of toners is brittleness which causes the resin to fracture when impacted. This allows rapid particle reduction in aerators, hammer mills and jet mills used to convert the pellets into dry toner particles.

The equipment heretofore described for the manufacture of toners is large and very expensive, yet capable of producing extremely large quantities of toner in a relatively short period of time. Further, toners tend to be customized for a particular copy machine and different blends of toners are required for each particular copy machine. Furthermore, color toners, including the primary color toners, namely, cyan, magenta, and yellow, are manufactured in much lower quantities than black toners for monochromic copier machines. Furthermore, custom colors are now available for a particular customer's requirements and may be unique to that particular customer. These color toners have particularly low volumes. The combination of just-in-time, zero inventory type of on-demand production philosophies, low quantity needs of a large number of toners and the high capacity and large expense of an extruder and related toner manufacturing equipment has necessitated the frequent changeover of an extruder line from one toner to another. When changing from one lot of toner to another, as well as during shutdowns at the end of the shift, the remaining toner must be removed from the extruder as well as from the jet mill.

A jet mill typically includes a housing which forms a grind chamber therein. A compressed fluid, in particular air, is added from outside the grind chamber into the grind chamber through nozzles in the periphery of the housing.

Upon shutdown between different lots of toner or at the end of a production shift, ground material within the grind chamber has been found to frequently be flowing back into the nozzles. The ground material in the nozzles have a tendency to plug the nozzles upon startup of the next lot. When the nozzles are plugged, no compressed air reaches the grind chamber. The material in that case is not ground. To clean the ground material which was clogged within the nozzles, the grinder would then have to be disassembled and some of the material removed to clean the nozzles. This problem causes considerable down time as well as the loss of the material which is removed from the nozzles in the grind chamber.

The following disclosures may be relevant to various aspects of the present invention:

U.S. Pat. No. 4,018,388
Patentee: Andrews
Issue Date: Apr. 19, 1977

U.S. Pat. No. 4,198,004
Patentee: Albus et al.
Issue Date: Apr. 15, 1980

U.S. Pat. No. 4,248,387
Patentee: Andrews
Issue Date: Feb. 3, 1981

U.S. Pat. No. 4,504,017
Patentee: Andrews
Issue Date: Mar. 12, 1985

U.S. Pat. No. 5,133,504
Patentee: Smith et al.
Issue Date: Jul. 28, 1992

U.S. patent application Ser. No. 08/402,230
Applicants: Higuchi et al.
Filing Date: Mar. 3, 1995

The relevant portions of the foregoing disclosures may be briefly summarized as follows:

U.S. Pat. No. 4,018,388 discloses a jet-type grinding mill having a circular chamber in which a rotating vortex is formed by gaseous fluid injected into the chamber. The material to be ground is feed into the mill through a feeder at the center of the vortex. There is a central recess at the bottom of the chamber below the feed inlet which has upwardly inclined walls to direct the fed particles upwardly and and outwardly into the vortex.

In U.S. Pat. No. 4,198,004 significant improvement in the sharpness with which particles are classified by size in a recirculating jet mill is achieved by the provision of an elongated, flexible barrier strip located adjacent the outermost part of wall of the classifier section. The positions for both ends of the strip are adjustable for controlling classification. The cross section of the classifier section is pear shaped, the narrower portion of the cross-section is toward the outside of the classifier section. The barrier strip is within the narrow portion.

U.S. Pat. No. 4,248,387 discloses a re-entrant circulating stream will which vents a part of the recirculating stream adjacent the annular peripheral wall of the mill directly to the junction in each of a plurality of sets of pressure nozzles and cooperating acceleration tubes which are used to form the circulating stream. Each pressure nozzle provides a high velocity gaseous jet stream that entrains material as it enters the acceleration tube where the material is accelerated to its maximum velocity before it is discharged into the vortex chamber of the mill and impacts upon the circulating stream adjacent the peripheral wall of the vortex chamber. The apparatus also takes advantage of the communication of the material which takes place in the acceleration tube.

U.S. Pat. No. 4,504,017 discloses an apparatus for comminuting materials to an extremely fine size. The apparatus includes a circulating stream jet mill and a discrete but functionally interconnected and interdependent rotating anvil-jet impact mill. New material is injected into the impact mill against a rotor. The partly comminuted material is transferred to the jet mill with vortex feed into the jet mill. Uncomminuted material in jet mill is reinjected into the impact mill. The two mills transfer the material back and forth until the particles are are comminuted, classified, and removed from the jet mill. The anvil jet mill is provided with stationary anvils and support for turning the rotor at increased velocity.

U.S. Pat. No. 5,133,504 discloses a fluidized bed jet mill including a grinding chamber with a peripheral wall, a base, and a central axis. An impact target is mounted within the grinding chamber and centered on the chamber's central axis. Multiple sources of high velocity gas are mounted in the periphery wall of the grinding chamber, are arrayed symmetrically about the central axis, and are oriented to direct high velocity gas along an axis intersecting the center of the impact target.

U.S. patent application Ser. No. 08/402,230 (Higuchi et al.) discloses an apparatus for the mixing of toner and a material to form a toner mixture. The apparatus includes a grinder having a grinding chamber within the grinder and a material adder for adding the material into the grinding chamber. The apparatus further includes a mixer for mixing the toner and the material within the grinding chamber to form the toner mixture.

In accordance with one aspect of the present invention, there is provided a mill for grinding marking particles utilizing a source of a pressurized fluid. The mill includes a grinding chamber having a peripheral wall, a base and a central axis. The mill also includes a nozzle associated with the peripheral wall of the grinding chamber. The nozzle defines an inlet of the nozzle. The inlet is connectable to the source of pressurized fluid. The pressurized fluid propels the marking particles about the periphery of the chamber. The mill further includes a plug cooperable with the nozzle. The plug is in engagement the nozzle when the pressure within the grinding chamber is substantially greater than the pressure at the inlet of the nozzle. The plug is spaced from the nozzle when the pressure within the grinding chamber is substantially less than the pressure at the inlet of the nozzle, so that when the source of pressurized fluid is connected to the inlet, the plug is spaced from the nozzle permitting the entry of the pressurized fluid into the chamber and so that when the source of pressurized fluid is disconnected from the inlet, the plug is engaged with the nozzle preventing marking particles from entering the nozzle and clogging the nozzle.

In accordance with another aspect of the present invention, there is provided a method for preventing the back flow of marking particles from a chamber of a mill into a fluid nozzle located located on the periphery of the chamber utilizing a plug. The method includes the steps of depositing the particulate material into the chamber of the grinder, adding compressed fluid into the chamber of the grinder through the nozzle, and seating the plug into the nozzle when the pressure within the chamber of the mill is greater than the pressure outside the chamber of the mill.

The invention will be described in detail herein with reference to the following Figures in which like reference numerals denote like elements and wherein.

Figure 1:
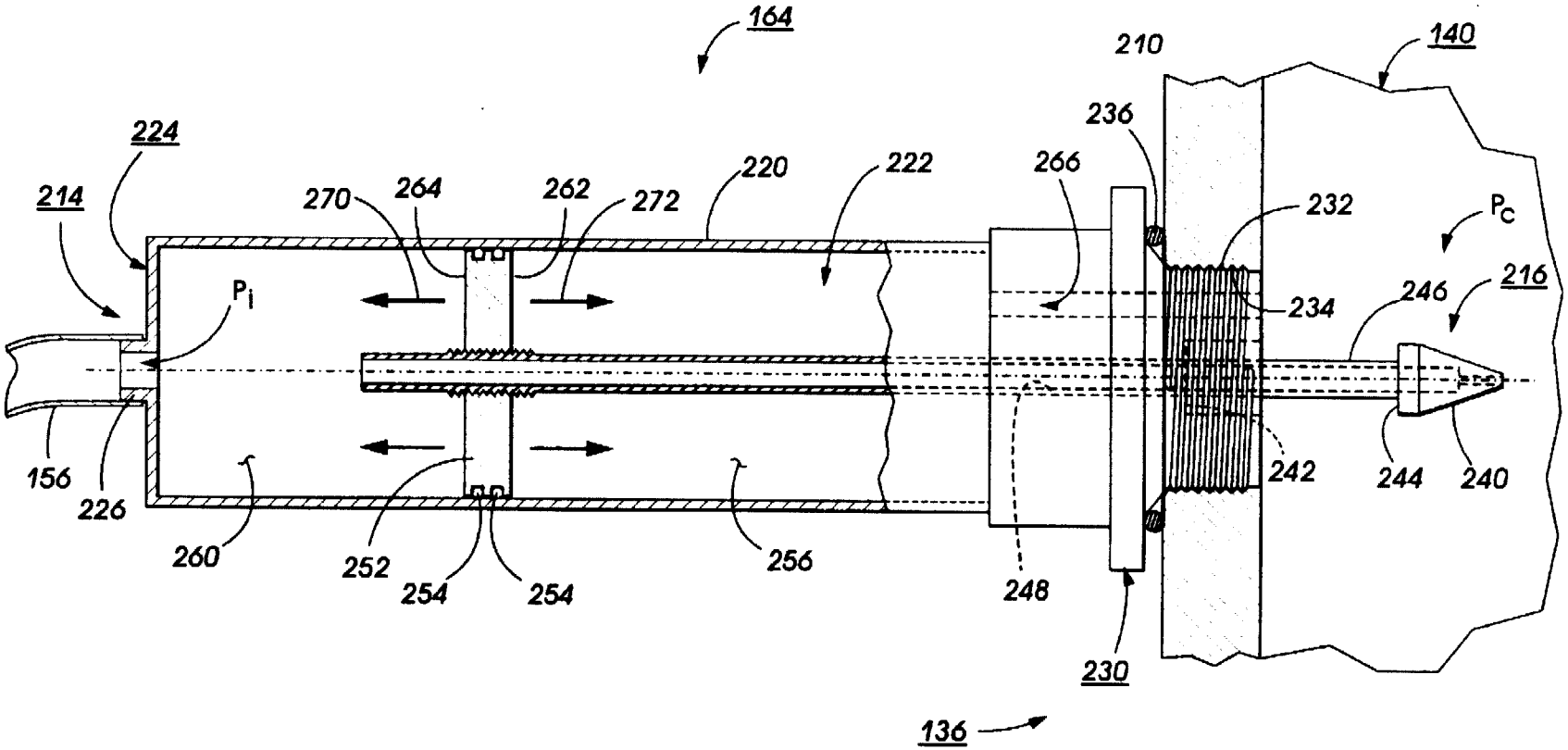
FIG. 1 is an plan view of a nozzle including the air actuated nozzle plug of the present invention.

According to the present invention, the toner created by the process of this invention comprises a resin, a colorant, and preferably a charge control additive and other known additives. The colorant is a particulate pigment, or alternatively in the form of a dye.

Numerous colorants can be used in this process, including but not limited to:

| Pigment Brand Name | Manufacturer | Pigment Color Index |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow TY-858-D | Heubach | Yellow 74 |
| Hansa Yellow X | Hoechst | Yellow 75 |
| Novoperm ® Yellow HR | Hoechst | Yellow 75 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | |
| L75-1331 Yellow | Sun Chem. | |
| L75-2377 Yellow | Sun Chem. | |
| Hostaperm ® Orange GR | Hoechst | Orange 43 |
| Paliogen ® Orange | BASF | Orange 51 |
| Irgalite ® 4BL | Ciba-Geigy | Red 57:1 |
| Fanal Pink | BASF | Red 81 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | |
| Heliogen ® Blue K 7090 | BASF | Blue 15:3 |
| Heliogen ® Blue K 7090 | BASF | Blue 15:3 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | |
| Mogul L | Cabot | |
| BK 8200 Black Toner | Paul Uhlich | |

Any suitable toner resin can be mixed with the colorant by the downstream injection of the colorant dispersion. Examples of suitable toner resins which can be used include but are not limited to polyamides, epoxies, diolefins, polyesters, polyurethanes, vinyl resins and polymeric esterification products of a dicarboxylic acid and a diol comprising a diphenol. Any suitable vinyl resin may be selected for the toner resins of the present application, including homopolymers or copolymers of two or more vinyl monomers. Typical vinyl monomeric units include: styrene, p-chlorostyrene, vinyl naphthalene, unsaturated monoolefins such as ethylene, propylene, butylene, and isobutylene; vinyl halides such as vinyl chloride, vinyl bromide, vinyl fluoride, vinyl acetate, vinyl propionate, vinyl benzoate, vinyl butyrate, and the like; vinyl esters such as esters of monocarboxylic acids including methyl acrylate, dodecyl acrylate, n-octyl acrylate, 2- chloroethyl acrylate, phenyl acrylate, methylalpha-chloroacrylate, methyl methacrylate, ethyl methacrylate, and butyl methacrylate; acrylonitrile, methacrylonitrile, acrylimide; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; styrene butadiene copolymers, Pliolites, available from Goodyear Company, and mixtures thereof.

Particularly preferred are resins comprising a copolymer of styrene and butadiene which comprises 89 percent by weight of styrene and 11 percent by weight of butadiene, and a copolymer of styrene and n-butyl methacrylate which comprises 58% by weight of styrene and 42 percent by weight of n-butyl methacrylate.

The resin or resins are generally present in the resin-toner mixture in an amount of from about 50 percent to about 100 percent by weight of the toner composition, and preferably from about 80 percent to about 100 percent by weight.

Additional components of the toner may be added to the resin prior to mixing the toner with the additive. Alternatively, these components may be added during extrusion. Some of the additional components may be added after extrusion, such as the charge control additives, particularly when the pigmented toner is to be used in a liquid developer. These components include but are not limited to stabilizers, waxes, flow agents, other toners and charge control additives.

Various known suitable effective charge control additives can be incorporated into the toner compositions of the present invention, such as quaternary ammonium compounds and alkyl pyridinium compounds, including cetyl pyridinium halides and cetyl pyridinium tetrafluoroborates, as disclosed in U.S. Pat. No. 4,298,672, the disclosure of which is totally incorporated herein by reference, distearyl dimethyl ammonium methyl sulfate, and the like. Particularly preferred as a charge control agent is cetyl pyridinium chloride. The charge enhancing additives are usually present in the final toner composition in an amount of from about 1 percent by weight to about 20 percent by weight.

Other additives may also be present in toners obtained by the process of the present invention. External additives may be applied, for example, in instances such as when toner flow is to be assisted, or when lubrication is needed to assist a function such as cleaning of the photoreceptor. The amounts of external additives are measured in terms of percentage by weight of the toner composition, but are not themselves included when calculating the percentage composition of the toner. For example, a toner composition containing a resin, a colorant, and an external additive may comprise 80 percent by weight resin and 20 percent by weight colorant; the amount of external additive present is reported in terms of its percent by weight of the combined resin and colorant.

External additives may include any additives suitable for use in electrostatographic toners, including fumed silica, silicon derivatives such as Aerosil® R972, available from Degussa, Inc., ferric oxide, hydroxy terminated polyethylenes such as Unilin®, polyolefin waxes, which preferably are low molecular weight materials, including those with a molecular weight of from about 1,000 to about 20,000, and including polyethylenes and polypropylenes, polymethylmethacrylate, zinc stearate, chromium oxide, aluminum oxide, titanium oxide, stearic acid, polyvinylidene fluorides such as Kynar, and other known or suitable additives. External additives may be present in any amount, provided that the objectives of the present invention are achieved, and preferably are present in amounts of from about 0.1 to about 1 percent by weight. For the process of the present invention, these additives may preferably be introduced onto the toner particles after mixing with the colorant and subsequent pulverization and classification.

Figure 3:
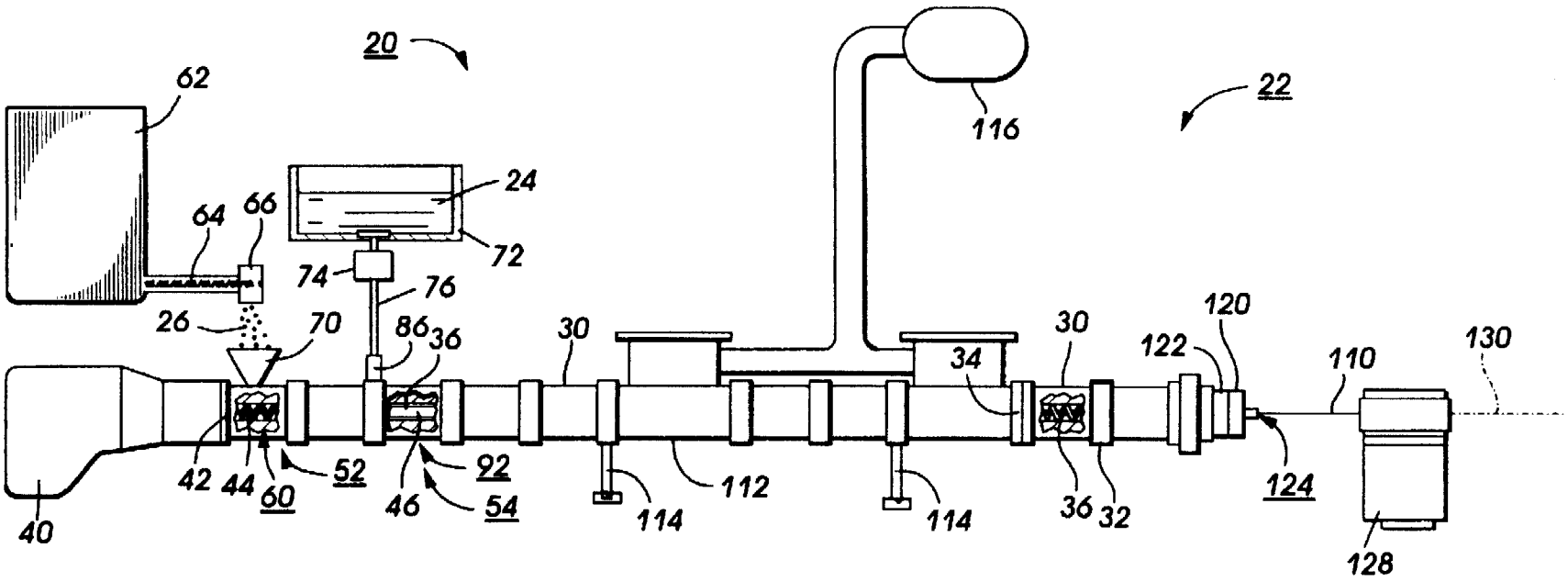
FIG. 3 is a schematic elevational view of an extruder for use with the micronization system of FIG. 2.
Figure 4:
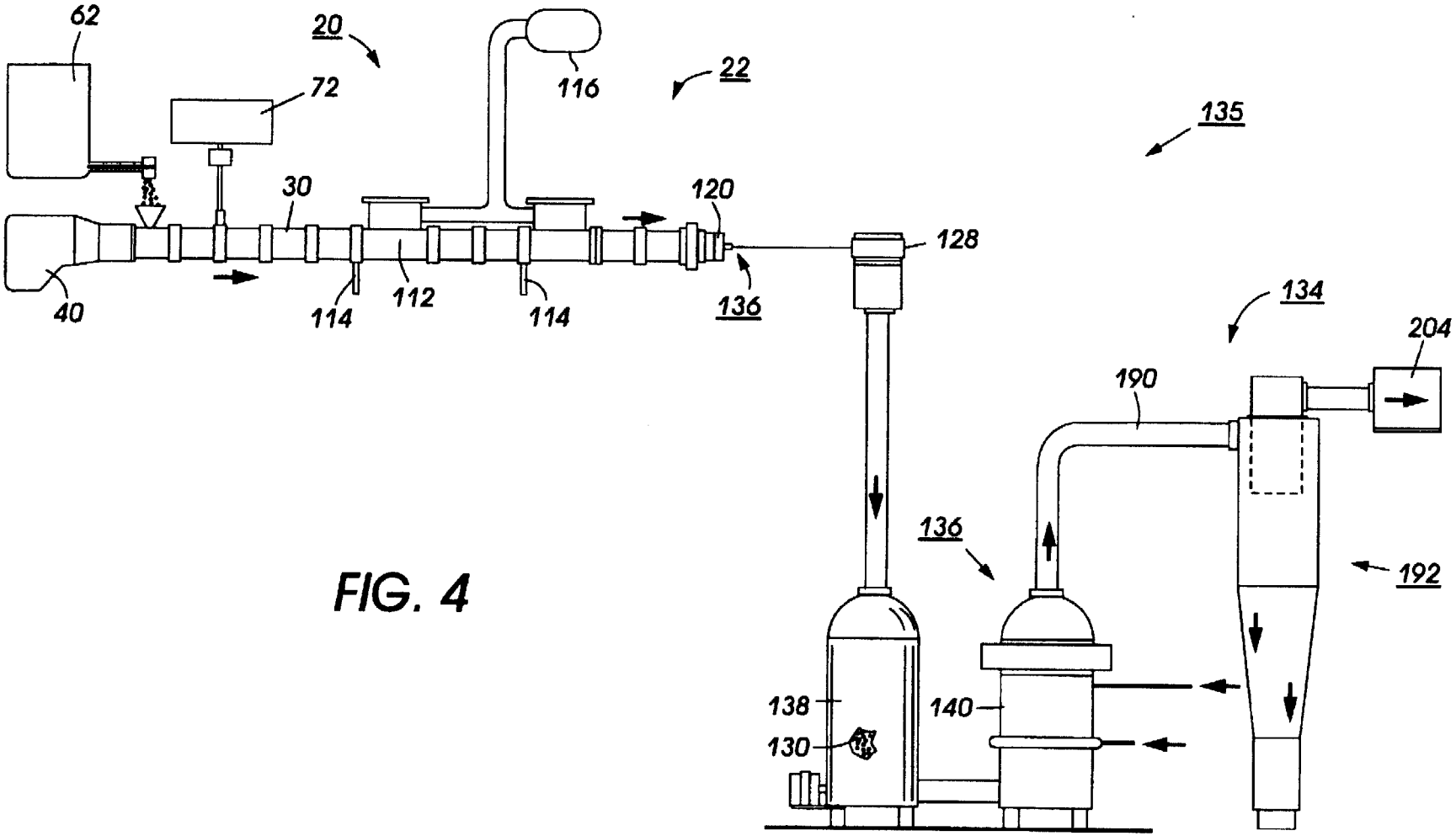
FIG. 4 is a schematic elevational view of a toner manufacturing system including the micronization system of FIG. 2 and the extruder of FIG. 3.

A toner composition may be manufactured by any known method, but preferably is manufactured by an extrusion process on an extruder. Such an extruder is shown in FIG. 3. Referring now to FIG. 3, an extruder system 20 is shown. The extruder system 20 includes an extruder 22 for mixing colorant 24 with dry resin 26 and for converting the dry resin 26 into a liquid form. Generally, any extruder, such as a single or twin screw extruder, suitable for preparing electrophotographic toners, may be employed for mixing the colorant 24 with the resin 26. For example a Werner Pfleiderer WP-28 extruder equipped with a 15 horsepower motor is well-suited for melt-blending the resin 26, a colorant 24, and additives. This extruder has a 28 mm barrel diameter, and is considered semiworks-scale, running at peak throughputs of about 3 to 12 lbs./hour. A typical extruder 22 includes a series of interconnected housings 30. The housings 30 are interconnected by flanges 32 at ends 34 of the housings 30. Feed screws 36 are located within the housings 30. Each housing 30 may have a solitary screw 36 or the housings 30 may include a pair of screws 36.

Again referring to FIG. 3, a power source 40, preferably in the form of an electric motor, is located on an end 42 of the extruder 22. The motor 40 serves to rotate the screws 36, each of the screws 36 being mechanically connected to the motor 40. The screws 36 may be in the form a spiral feed screw 44 for propelling the resin 26 and colorant 24 through the extruder 22 or in the form of kneading screws having either no spiral or a reverse spiral which are used to disperse the other constituents including the colorant 24 into the resin 26. The screws 36 thus within each housing 30 are either the spiral screw 44 or a mixing screw 46. Each of the housings 30 thus form zones. In a preferred twin screw extruder, there are specific zones along the entire length of the extruder 22 which may be the same or different for each section 30. The zones may include feed zones 52 and mixing zones 54 with each feed zone 52 having at least one feed screw 44 and with each mixing zone 54 having at least one mixing screw 46. In the feed zone 52, resin 26 is metered into the extruder 22. The temperature is maintained below the resin melt point. If the resin begins to melt at the feed port, the entry clogs, and the extruder 22 often stalls.

At a first feed zone 60, the resin 26 is added to the extruder 22. The resin 26 is stored adjacent the extruder 22 in a dry toner resin feeder hopper 62. The resin 26 is uniformly fed from the hopper 62 by an auger 64 to a resin hopper outlet 66. The resin hopper outlet 66 is located adjacent a extruder resin inlet 70 into which the resin 26 is deposited.

After the resin 26 is added to the extruder 22, the colorant 24 is added to the extruder 22. The resin 26 may travel through one or more of the feed zones 52 before entering the area where the colorant 24 is added. The colorant 24 is preferably stored in a separate container such as a colorant tank 72. The colorant 24 at this stage may be either a dispersion of pigment in liquid, a solution of dye or a colorant in a melted state. To accommodate the caustic nature of the colorant solution, the tank 72 is preferably made of stainless steel or contains a glass liner (not shown). The tank 72 may be portable and may include rollers (not shown) to ease the movement of the tank 72. A first conduit 76 interconnects the tank 72 to the extruder 22. The first conduit 76 is preferably in the form of non-corrosive tubing, such as stainless steel tubing.

The first conduit 76 connects pump 74 to an injection nozzle 86 in the extruder 22. The colorant 24 within the injection nozzle 86 then enters a high intensity mixing zone 92.

As the colorant 24 is mixed with resin 26, an extrudate 110 is formed which contains the colorant 24 evenly distributed within the resin 26. The mixing screws 46 are preferably turned at the fastest rate which allows the molten resin to achieve the desired temperatures. Faster screw speeds provide higher energy mixing and greater throughputs, but above a certain rate, the resin 26 is moving too fast to equilibrate with the barrel temperature, and dispersion quality degrades.

The extrudate 110 passes from the high intensity mixing zone 92 to the next adjoining zone. The next adjoining zone may be one of the feed zones 52 or one of the mixing zones 54. The extrudate 110 next preferably passes an evaporation zone 112 where conduit 114 passes water into the extruder 22. Due to the heat generated in the high intensity mixing zone 92, the temperature of the extrudate 110 in the evaporating zone 112 is preferably significantly above 100° C. and therefore the water which is added by the conduit 114 to the evaporation zone 112 evaporates into steam which is drawn from the evaporation zone by a vacuum port 116. Along with the steam leaving through the vacuum port 116 are volatile chemicals (not shown) which are likewise drawn from the extruder at the vacuum port 116. The extrudate continues to pass through the extruder 22 to a die plate 120 located at an outlet 122 of the extruder 22. The die plate 120 includes an aperture 124 or multiple apertures through which the extrudate 110 exits the extruder 22. At the die plate 120, the temperature is raised from approximately 110° C. to above 200° C. temperature to obtain a temperature which fluidizes the extrudate and causes it to flow freely through the aperture 124. The pressure in the preceding mixing zone can be increased by restricting the size of the aperture 124, at the expense of throughput. The aperture 124 is chosen of suitable size to provide flow sufficient to provide for a commercially acceptable process.

The extrudate 110 from the extruder 22 is cooled by spray or immersion in water prior to cutting the strands with a rotary knife or other suitable means. For example, a rotary cutter 128, such as an Alpine® Cutter or Fitz® Miller, may be used to reduce the size of the resin particles. The rotary cutter 128 cuts the extrudate 110 into pellets 130.

After the resin has been extruded, the resin mixture is reduced in size by any suitable method including those known in the art. An important property of toners is brittleness which causes the resin to fracture when impacted. This allows rapid particle size reduction in attritors, other media mills, or even jet mills used to make dry toner particles. It should be appreciated that the particle size reduction may possibly include the use of a pulverizer (not shown). The pulverizer may be a hammer mill such as, for example, an Alpine® Hammer Mill. The hammer reduces the toner particles to a size of about 100 μm to about 300 μm. Applicants have found that the invention may be practiced without the use of the hammer mill.

Figure 2:
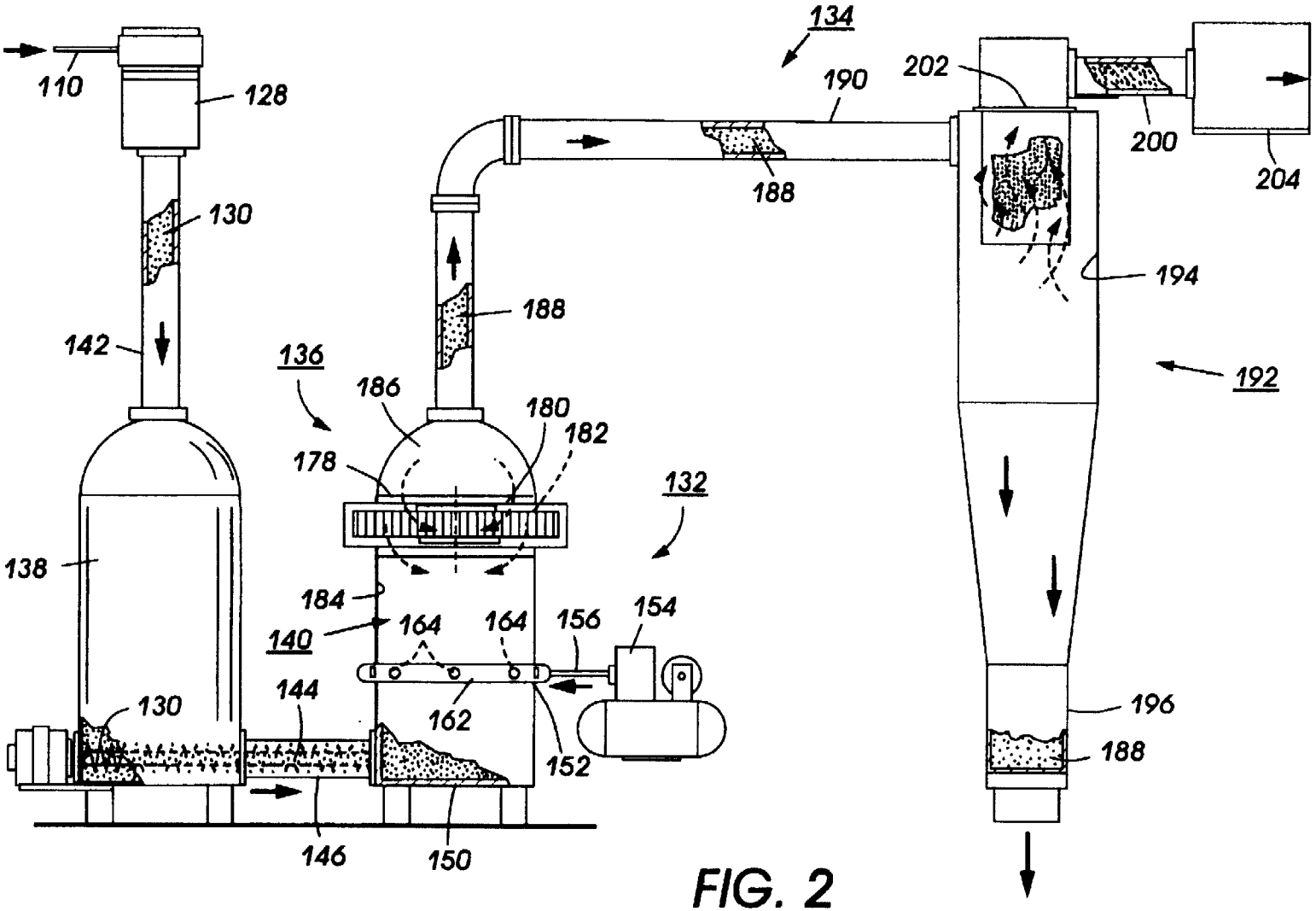
FIG. 2 is a schematic elevational view of micronization system utilizing air actuated nozzle plug of the present invention.

Referring to FIG. 2, an additive injection blender 132 is shown as part of a micronization system 134. The micronization system 134 serves to reduce the particle size of the pellets 130 into toner particles of an appropriate size, such as four to eight microns. The micronization system 134 is connected to the extruder system 20 to form a toner manufacturing system 135.

As earlier stated, an important property of toners is brittleness, which causes the resin to fracture when impacted. This allows rapid particle size reduction in aerators, other media mills, or even jet mills to make dry toner particles.

The micronization system 134 includes a micronizer 136 which provides for the rapid particle size reduction of the pellets 130 into toner particles. Preferably, the micronizer is a jet-type micronizer such as a jet mill. Jet mills containing a milling section into which water vapor jets or air jets are blown at high speeds and the solid matter to be micronized is brought in across an injector by a propellant. Compressed air or water vapor is usually used as the propellant in this process. The introduction of the solid matter into the injector usually occurs across a feeding hopper or entry chute.

For example, the micronizer 136 may be a Sturtevant 15 inch jet mill having a feed pressure of about 114 psi and a grinding pressure of about 119 psi may be used in the preparation of the toner resin particles. The nozzles of this jet mill are arranged around the perimeter of a ring. Feed material is introduced by a pneumatic delivery device and transported to the injector nozzle. The particles collide with one another and are attrited. These particles stay in the grinding zone by centrifugal force until they are small enough to be carried out and collected by a cyclone separator. A further size classification may be performed by an air classifier.

Preferably, however, the micronizer 136 is in the form of an AFG-800 grinder. The AFG-800 grinder is a fluidized air mill made by AFG (Alpine Fliebbertt-Gegenstrahlmuhle). The micronizer 136 is shown in greater detail in FIG. 2. Referring to FIG. 2, the micronizer includes a feed chamber 138 and a grind chamber 140. A pipe or tube 142 connects the rotary cutter 128 with the feed chamber 138. The pipe 142 is made of any suitable durable material which is not interactive with the toner composition, such as stainless steel. The pellets 130 are propelled toward the feed chamber 138 by any suitable means such as by augers (not shown) or by blowers (not shown). The pellets 130 accumulated in the feed chamber 138 are extracted from the feed chamber 138 by a screw 144 located in a tube or pipe 146 interconnecting the feed chamber 138 with the grind chamber 140. The screw 144 and the pipe 146 are made of any suitable durable material which is not chemically interactive with the toner, such as stainless steel. The pellets 130 enter lower portion 150 of the grind chamber 140.

A pressurized fluid, preferably in the form of compressed air is added to the grind chamber 140 in a lower central portion 152 of the grind chamber 140. The compressed air is supplied by any suitable compressed air source 154, such as an air compressor. Compressed air conduit 156 interconnects the compressed air source with a ring 162 located around the grind chamber 140. Extending inwardly from the ring 162 are a series of inwardly pointing nozzles 164 through which the compressed air enters the grind chamber 140. The compressed air causes the pellets 130 to accelerate rapidly upwardly within the grind chamber 140.

In an upper portion 178 of the grind chamber 140 a series of rotating classifier wheels 180 set the toner air mixture into rapid rotation. The classifier wheels 180 include fins 182 along the periphery of the classifier wheels 180. The wheels 180 cause the larger particles, pellets 130, to be propelled to inner periphery 184 of the grind chamber 140 and to return to the lower portion 150 of the grind chamber 140. The pellets 130 impact each other and the components of the micronizer 136 and thereby micronize the toner into micronized toner 188. The micronized toner 188, on the other hand, is permitted to move upwardly within the grind chamber 140 into manifold 186.

A long connecting pipe 190 is connected on one end thereof to manifold 186 and on the other end thereof to a product cyclone 192. The long connecting pipe 190 serves to provide a conduit between the grind chamber 140 and the product cyclone 192 for the micronized toner 188. The long connecting pipe 190 may be of any suitable durable material, such as stainless steel.

The product cyclone 192 is designed to separate particles from the air stream in which they are carried. The product cyclone 192 may be any suitable commercially available cyclone manufactured for this purpose and may, for example, include a (quad) cyclone which consists of four cyclones combined. Within the product cyclone 192, the micronized toner 188 circulates in a spinning manner about inner periphery 194 of the cyclone 192. The larger micronized toner 188 has a greater mass and is thereby propelled to the inner periphery 194 of the cyclone 192, falling into lower portion 196 of the product cyclone 192. Air and very small dust particles 200 having a lesser mass and a particle size of, perhaps, less than 1 microns are drawn upwardly through upper opening 202 of the cyclone 192 into dust collector 204. The micronized toner 188 collects in the lower portion 196 of the cyclone 192 and is extracted therefrom.

Figure 5:
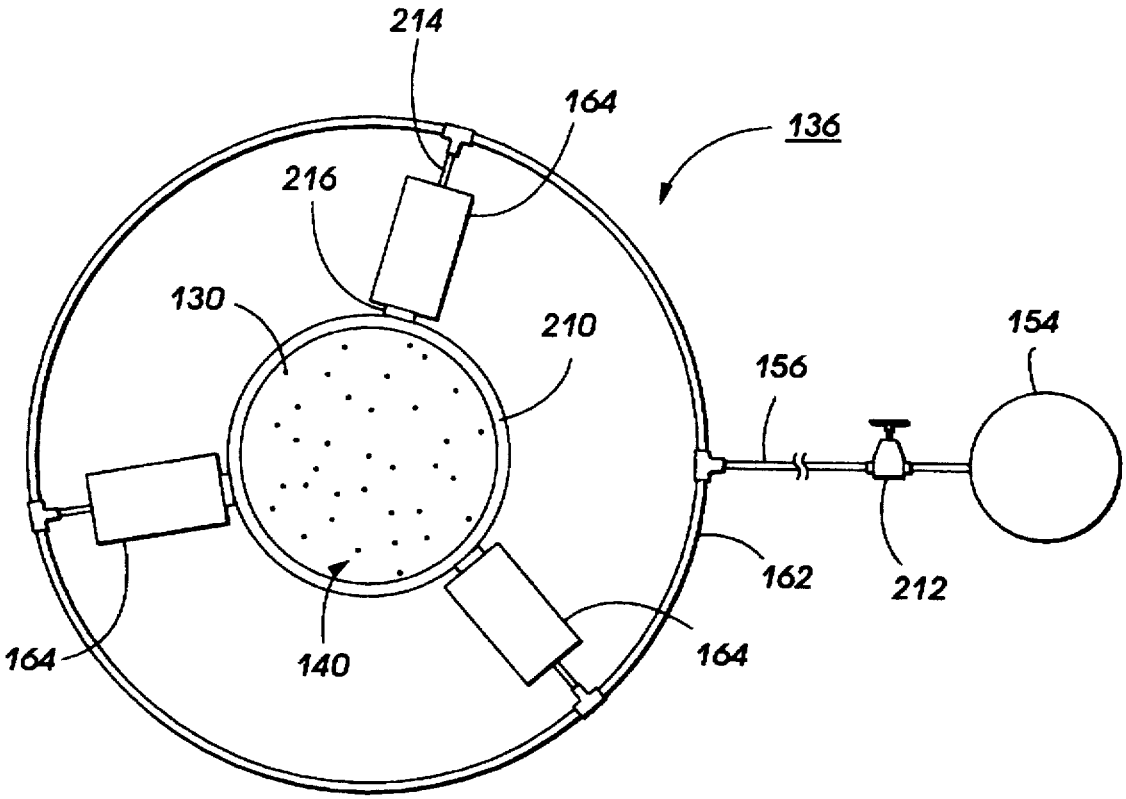
FIG. 5 is a top view of a jet mill utilizing the nozzle plug of the present invention.

According to the present invention and referring to FIG. 5, the mill of the present invention is shown in greater detail. The nozzle 164 is preferably mounted in outer wall 210 of the mill 136. While the invention may be practiced with a solitary nozzle 164, preferably a plurality of nozzles are used, for example, three equally spaced nozzles 164. A valve 212 is preferably positioned in compressed air conduit 156 to control the flow of pressurized fluid from the compressed air source 154. The nozzle 164 has an inlet 214 which is connected to the ring 162 as well as an outlet 216 which is pointed inwardly toward the center of the grind chamber 140.

The nozzle 164 is shown in greater detail in FIG. 1. The nozzle 164 includes a body 220. The body 220 may have any suitable shape and preferably includes an inner chamber 222. The body 220 preferably has the shape of a tube, for example, a cylindrical tube. The body 220 includes a first end 224 which includes an inlet opening 226 located adjacent the inlet 214. The inlet opening 226 interconnects the chamber 222 to the air conduit 156. The body 220 also includes a second end 230 where the body 220 is connected to the wall 210 of the mill 136. The body 220 is made of any suitable durable material, for example, a metal or a plastic, and is preferably made of a material non-chemically interactive with the toner material. The second end 230 is connected to the wall 210 by any suitable method, such as by fasteners, adhesives, or by welding. For example, the body 220 may include external threads 232 which mate with internal threads 234 in the wall 210. An O-ring 236 may be further used to seal the second end 230 to the body 220 to the wall 210.

A plug 240 is cooperable with the nozzle 164 and is used to seal the outlet 216 of the nozzle 164 when the pressure $P_c$ of the grind chamber 140 is greater than the pressure $P_i$ of the inlet opening 226. The plug 240 may cooperate with the outlet 216 of the nozzle 164 in any suitable fashion, but preferably the second end 230 of the nozzle 164 includes a seat 242 which mates with surface 244 of the plug 240. The plug 240 may be made of any suitable durable material, for example, a metal or a plastic, and is preferably made of a material non-chemically interactive with the toner.

The plug 240 may be engageable with the seat 242 in any suitable fashion. For example, the plug 240 may be connected to a nozzle shaft 246 which is slidable through an opening 248 in the second end 230 of the body 220 of the nozzle 164. The nozzle shaft 246 moves the plug 240 axially inward and outward into engagement with the seat 242. Preferably, the nozzle shaft 246 is hollow providing an aperture therein through which air may be directed into the grind chamber 140.

Preferably, the nozzle shaft 246 is connected with a member 252 which is operably associated with the plug 240. Preferably the member 252 is in the form of a piston which is slidable within the inner chamber 222 of the body 220 of the nozzle 164. Preferably, the piston 252 is in close sliding contact with the body 220. A sealing member, for example, an O-ring or a pair of O-rings 254 are used to seal the space between the body 220 and the piston 252. The piston 252 is secured to the shaft 246 in any suitable method, for example, by threaded engagement thereto. The piston 252 divides the inner chamber 222 into two portions, an outlet portion 256 and an inlet portion 260.

The piston 252 includes a first surface 262 which is in contact with the outlet portion 256 and a second surface 264 which is is contact with the inlet portion 260. Preferably, the outlet portion 256 is in communication with the grind chamber 140. This communication may be accomplished by a second end aperture or opening 266 through the body 220 of the nozzle 164. The inlet portion 260 is in communication with the pressurized fluid or compressed air source 154. (See FIG. 5).

Referring again to FIG. 1, when pressure $P_c$ in the chamber 140 is greater than pressure $P_i$ at the inlet opening 226, the piston 252 moves in the direction of arrow 270. When the pressure $P_i$ at the inlet opening 226 is greater than the pressure Pc of the chamber 140, the piston 252 moves in the direction of arrow 272, separating the plug 240 from the seat 242 thereby opening the nozzle 164. When the piston 252 moves in the direction of arrow 270, the plug 240 seats against the seat 242 closing the nozzle 164.

During normal operation when the mill is grinding the pellets 130, the pressure $P_i$ is greater substantially than the pressure $P_c$ in the chamber 140. During this time, the piston 252 has been moved in the direction of arrow 272 to separate the plug 240 from the seat 242 permitting the pressurized fluid to flow freely through the nozzle 164. On the other hand, during shutdown of the mill, when the valve 212 (see FIG. 5) is shut, the pressure Pc within the chamber 140 may exceed the pressure $P_i$ in the inlet opening 226. When the pressure $P_c$ is greater than the pressure $P_i$, the piston 252 moves in the direction of arrow 270 seating the plug 240 against the seat 242 and preventing the passage of toner particles into the nozzle 164.

By providing a nozzle according to the present invention, having a plug which prevents the back flow of toner into the nozzle, the ground material will not plug the nozzles preventing proper operation of the mill.

By providing a nozzle including a plug which seals the nozzle when the pressure within the chamber exceeds that outside the chamber, the nozzles do not become contaminated with ground material during shutdown, and do not need to be cleaned.

By providing the nozzles including a plug which prevents the back flow of ground material into the nozzles, cleaning of the nozzles during changeover from one toner lot to another, is eliminated.

By providing a nozzle 164 including a plug 240, which nozzle has a piston which is slidably moved by the pressure within the mill on one surface and the pressure outside the mill on the other surface, the plug 240 may be seated appropriately depending on the pressure within the chamber to prevent the back flow of ground material into the nozzle.

It should be appreciated that other methods may be used to reduce the size of the toner, including methods that may be applied when the toner will be used to form a liquid developer. Such methods include, for example, post-processing with an attritor, vertical or horizontal mills or even reducing toner particle size in a liquid jet interaction chamber. Additives such as charge control agents may be added to the liquid developer.

While the invention has been described with reference to the structures and embodiments disclosed herein, it is not confined to the details set forth, and encompasses such modifications or changes as may come within the purpose of the invention.

We claim:

1. A mill for grinding marking particles utilizing a source of a pressurized fluid, said mill comprising:

a grinding chamber having a peripheral wall, a base and a central axis;

a nozzle mounted to the peripheral wall of said grinding chamber, the nozzle having an inlet connectable to the source of pressurized fluid, the pressurized fluid propelling the marking particles about the peripheral wall of the chamber; and a plug cooperable with said nozzle, said plug being in engagement with said nozzle when the pressure within said grinding chamber is substantially greater than the pressure at the inlet of said nozzle and said plug being spaced from said nozzle when the pressure within said grinding chamber is substantially less than the pressure at the inlet of said nozzle, so that when the source of pressurized fluid is connected to the inlet, the plug is spaced from the nozzle permitting the entry of the pressurized fluid into the chamber and so that when the source of pressurized fluid is disconnected from the inlet, the plug is engaged with the nozzle preventing marking particles from entering the nozzle and clogging the nozzle.

2. The mill of claim 1, further comprising a feed chamber coupled to said grinding chamber.

3. The mill of claim 1, wherein the pressurized fluid comprises compressed air.

4. The mill of claim 1, further comprising a member operably associated with said plug, said member having a first surface in communication with said grinding chamber and a second surface in communication with the inlet of said nozzle.

5. The mill of claim 4, wherein said member comprises a piston.

6. The mill of claim 4 wherein said nozzle comprises a body defining a chamber therein, said member movable within the chamber.

7. The mill of claim 6, wherein:

said body comprises a cylindrical tube; and said member comprises a piston closely conforming to and slidable in the tube.

8. The mill of claim 7, further comprising a shaft connecting said piston to said plug.

9. The mill of claim 8, wherein said body of said nozzle defines a counterbore therein, said nozzle closely conformable to the counterbore.

10. The mill of claim 6, wherein said body further defines a aperture therein connecting the chamber of said body to said grinding chamber.

11. A method for preventing the back flow of marking particles from a chamber of a mill into a fluid nozzle located on the periphery of the chamber utilizing a plug, comprising the steps of:

depositing the marking particles into the chamber of the mill;

adding compressed fluid into the chamber of the mill through the nozzle; and seating the plug into the nozzle when the pressure within the chamber of the mill is greater than the pressure outside the chamber of the mill.

* * * * *